United States Patent [19]

Fischer

[11] Patent Number: 4,480,544

[45] Date of Patent: Nov. 6, 1984

[54] HIGH-PRODUCTION ROTARY OFFSET PRINTING MACHINE

[75] Inventor: Hermann Fischer, Augsburg, Fed. Rep. of Germany

[73] Assignee: M.A.N.-Roland Druckmaschinen Aktiengesellschaft, Offenbach am Main, Fed. Rep. of Germany

[21] Appl. No.: 465,498

[22] Filed: Feb. 10, 1983

[30] Foreign Application Priority Data

Mar. 4, 1982 [DE] Fed. Rep. of Germany ..... 3207791

[51] Int. Cl.[3] ..... B41F 7/02; B41F 13/00

[52] U.S. Cl. ..... 101/177; 101/181

[58] Field of Search ..... 101/175, 176, 177, 178, 101/179, 180, 181, 182, 220, 22, 137, 142, 217, 218, 183, 136, 138, 139

[56] References Cited

U.S. PATENT DOCUMENTS 1,646,034 10/1927 Mayer ..... 101/221

FOREIGN PATENT DOCUMENTS 2339323 2/1975 Fed. Rep. of Germany ..... 101/220

489839 8/1938 United Kingdom ..... 101/211

*Primary Examiner*—J. Reed Fisher

*Attorney, Agent, or Firm*—Frishauf, Holtz, Goodman & Woodward

[57] ABSTRACT

To double production rate of printed subject matter without increasing printing machine speed, a serially arranged row of printing stations, each having a blanket cylinder, a plate cylinder, and associated inkers—and dampers, if required—have two impression cylinders (21, 25) located for engagement with the end ones of the blanket cylinders (1, 5), so that inked printed information can be received from both ends of the serially positioned blanket cylinders. Ink applied to the respective blanket cylinders by the associated plate cylinders will migrate through the chain of blanket cylinders, with ink splitting occurring at each contact between the respective blanket cylinders, to provide sufficient inking at both of the blanket cylinders (1, 5) positioned at the end of the series of blanket cylinders (1–5).

2 Claims, 1 Drawing Figure

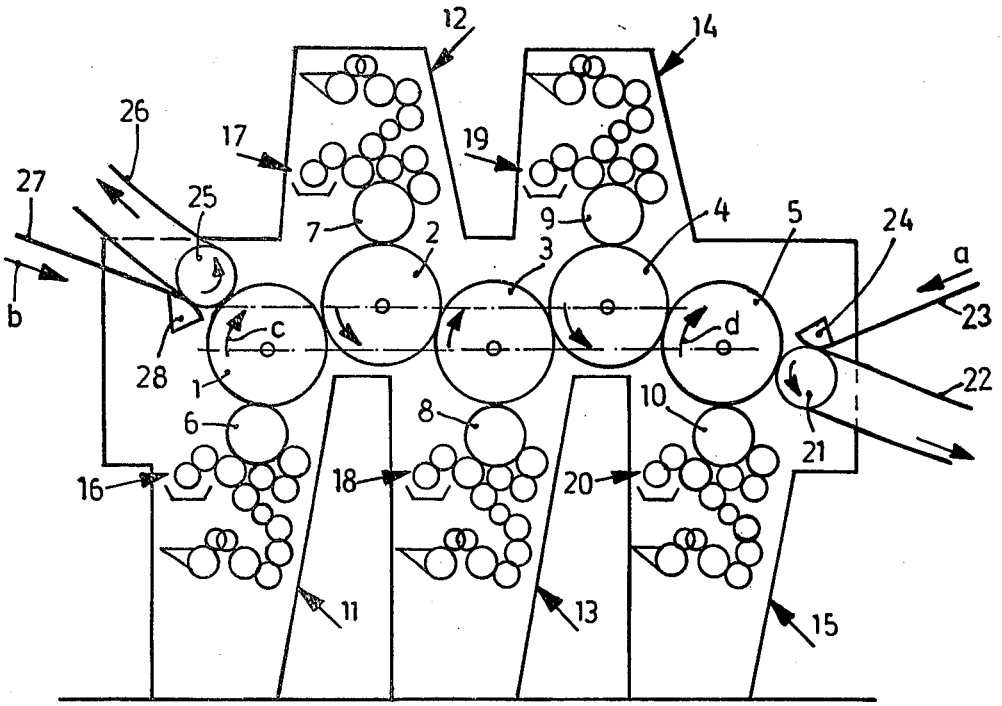
12
14
26
17
19
27
25
7
2
9
4
5
24
3
a
b
23
c
d
28
1
22
6
8
10
21
16
18
20
11
13
15

HIGH-PRODUCTION ROTARY OFFSET PRINTING MACHINE

Reference to related application, the disclosure of which is hereby incorporated by reference, assigned to the assignee of the present application: U.S. Ser. No. 06/460,408, filed Jan. 24, 1983, Fischer.

The present invention relates to rotary offset printing machines, and more particularly to multi-color printing machines, in which the rubber blanket cylinders are used for inked image transfer within the machine.

BACKGROUND

The copending application U.S. Ser. No. 06/460,408, filed Jan. 24, 1983, by the inventor hereof describes a multi-color offset rotary printing machine on which a plurality of blanket cylinders, of respective printing systems, each having a plate cylinder, inkers, and dampers, if needed, are positioned with respect to each other in ink liquid transferring relation. A partial image to be printed, for example in a first color, is applied to a blanket cylinder by a respective associated plate cylinder, and transferred to an adjacent contacting blanket cylinder which, additionally, receives a further partial image, for example in a different color. The now two-color image can be printed or transferred to yet another blanket cylinder which may receive a third partial image in a third color—and so on; eventually, an impression or printing cylinder engages a printing substrate against the final blanket cylinder. The last or final blanket cylinder in the series will carry a plurality of images, for example in different colors. The substrate is contacted only at the single impression line with the last blanket cylinder, so that paper of even poor quality can readily be printed with multi-color images without excessive tearing or kneading by being passed between a series of blanket cylinder-impression cylinder combinations.

THE INVENTION

It is an object to provide for increased production of an offset printing machine, and more particularly of the type described in the referenced application by the inventor hereof, without increasing the circumferential speed of the respective cylinders.

Briefly, the machine of the type described in the referenced application is further improved by providing a second impression or printing cylinder which contacts the first one of the blanket cylinders.

The present invention is based on the discovery that the plurality of engaging blanket cylinders will cause mutual transfer of partial images, due to ink splitting upon engagement of the respective cylinders, so that all the blanket cylinders will carry the entire printed subject matter, in all the respective colors. Thus, a printing substrate can be contacted against any one of the blanket cylinders, and will receive a complete printed image. It is possible, therefore, to engage a printing substrate not only with one blanket cylinder, but with any other one, or more than one. For accessibility, and positioning of the respective impression cylinders, the first and last one of the series of blanket cylinders which contact each other are the ones to which, preferably, the substrates are supplied for printing.

The substrates may be in sheet or continuous web form.

DRAWING

The single FIGURE shows, schematically, a side view of a rotary offset printing machine incorporating the principle of the present invention.

DETAILED DESCRIPTION

The printing machine has five printing stations, each including a blanket cylinder 1, 2, 3, 4, 5. Each blanket cylinder has a plate cylinder 6, 7, 8, 9, 10 associated therewith. Each plate cylinder has an inker 11, 12, 13, 14, 15 associated therewith. A damper 16, 17, 18, 19, 20 is provided for the respective plate cylinders as well; if only dry offset printing is to be used, the dampers need not be engaged, or need not even be present.

A first impression cylinder 21 is associated with the blanket cylinder 5. The shaft of the impression cylinder 21 additionally carries sprockets for a transport chain system 22 having grippers (not shown) thereon. The grippers of the transport chain system 22 receive sheets which are supplied from a make-ready table 23 by supply grippers 24, fed in the direction of the arrow a. The sheets, upon printing between the blanket cylinder 5 and the impression cylinder 21, and passage in part around the impression cylinder 21, are then transferred to the grippers on the chain transport 22, to permit the chain transport 22 to remove the printed sheets.

In accordance with the present invention, a second impression cylinder 25 is provided, positioned for printing engagement with blanket cylinder 1. The shaft of impression cylinder 25 again carries suitable sprockets or other appropriate wheels for a chain transport system 26, having grippers (not shown) to receive printed sheets. The grippers of the chain transport system 26 receive sheets supplied from a make-ready table 27 and transported by supply grippers 28 in the direction of the arrow b. The impression cylinder 25 is associated with the blanket cylinder 1 primarily to permit ready access to the respective printing stations of the printing machine, and thus, preferably, is engaged with the blanket cylinder which is opposite the blanket cylinder 5 engaged by the impression cylinder 21 in the series of engaging blanket cylinders.

Sheets fed by the grippers 28 are removed by the gripper system 26 after having been passed around the impression cylinder 25 and received printing from the blanket cylinder 1.

Operation

The blanket cylinders 1, 5 are engaged with each other when printing is to be effected. Each one of the blanket cylinders receives a partial image in a respective color by the associated plate cylinder. Since the blanket cylinders are in contact with each other, the partial images received from the associated plate cylinders will be transferred to the adjacent or neighboring blanket cylinder or cylinders. Thus, on all blanket cylinders 1–5, a complete five-color image will build up. It is thus possible to print on the printing lines between the blanket cylinder 1 and the impression cylinder 25, and the blanket cylinder 5 and the impression cylinder 21, respectively, and obtain a five-color printed image on each sheet. The sheets accept only part of the ink on the respective blanket cylinders 1, 5. The transfer of ink is insured, since the two blanket cylinders 1, 5, which rotate in the respective directions of the arrows c and d, respectively, after printing receive ink from the respective plate cylinders 6 and 10, as well as from the engaged blanket cylinders 2 and 4. Due to the splitting of ink at the nip or engagement of the respective blanket cylinders, ink is transferred from the plate cylinder 6, or plate cylinder 10, respectively, to the blanket cylinders 2 and 4, respectively. Similarly, due to splitting of ink between the blanket cylinders 2 to 4, ink from the plate cylinder 6 will migrate to the blanket cylinder 5, and the ink from the plate cylinder 10 will migrate to the blanket cylinder 1.

Various changes and modifications may be made; for example, the invention can be used with any rotary printing machines in which engaged blanket cylinders are employed. For example, the impression cylinders 21, 25 can apply a continuous web to the respective blanket cylinders 6 and 1. It is also possible to utilize more than two impression cylinders, with which a respective substrate is engaged against a blanket cylinder within the machine.

The printing machine, in accordance with the present invention, permits doubling production without increase of circumferential speed of the respective blanket cylinders 1 to 5. By engaging additional impression or printing cylinders with others of the blanket cylinders—if the layout of the machine permits, with suitable accessibility—additional production can be obtained since, then, the machine, per unit time, will print on two or more substrates.

Various other changes and modifications may be made, within the scope of the inventive concept.

I claim:

1. High-production rotary offset printing machine, for printing on two substrates, comprising at least two printing systems, each including a blanket cylinder (1–5);

a plate cylinder (6–10) associated with a respective blanket cylinder, and transferring a partial inked image to the associated blanket cylinder;

an inker (11, 15) associated with a respective plate cylinder (6, 10), said blanket cylinders of the at least two printing systems being positioned in mutually contacting arrangement for transfer of the respective partial images between each other, whereby each blanket cylinder will carry a composite image formed by the respective partial images;

a first impression cylinder (21) in engagement with one (5) of the blanket cylinders; and at least one further impression cylinder (25) positioned in engagement with another one (1) of the blanket cylinders to permit feeding one substrate between said one blanket cylinder and the first impression cylinder and feeding of another substrate between said another one (1) blanket cylinder and the further impression cylinder (25).

2. Printing machine according to claim 1, wherein at least three blanket cylinders are provided, positioned in serial engagement with each other;

the first impression cylinder (21) being located in engagement with one (5) of the blanket cylinders at one end of the series, and the at least one further impression cylinder (25) being located in engagement with the blanket cylinder (1) at the other end of the series of the serially arranged blanket cylinders (1–5).

* * * * *